United States Patent [19]

Basseches

[11] Patent Number: 4,661,081

[45] Date of Patent: Apr. 28, 1987

[54] BALLOON SUPPORT

[76] Inventor: Jack Basseches, Rue Paul Redfern, 24 Apt. 401, Rio de Janeiro, Brazil

[21] Appl. No.: 795,134

[22] Filed: Nov. 5, 1985

[51] Int. Cl.[4] ..... A63H 3/06

[52] U.S. Cl. ..... 446/220; 446/222

[58] Field of Search ..... 446/222, 220, 224; 24/30.5 S, 30.5 R

[56] References Cited

U.S. PATENT DOCUMENTS

| | | | |
|---|---|---|---|
| 2,396,906 | 3/1946 | Windson | 446/222 |
| 2,510,883 | 6/1950 | Goldberg | 446/222 X |
| 2,664,667 | 1/1954 | Burroughs | 446/222 |
| 2,882,645 | 4/1959 | Stivers | 446/220 |
| 2,981,990 | 5/1961 | Balderree, Jr. | 24/30.5 S |
| 3,366,999 | 2/1968 | Darby | 446/222 |
| 4,145,838 | 3/1979 | Mason | 446/220 X |

*Primary Examiner*—Mickey Yu

*Attorney, Agent, or Firm*—Beveridge, DeGrandi & Weilacher

[57] ABSTRACT

A balloon support is described which has a concave support part provided with at least one lateral opening and a fixing sleeve connected to the support part. An object of the invention is to provide a support of this type which permits contralized positioning of the balloon on the support. According to the invention, one lateral opening is connected to a bottom opening in the support part by a cut or slit, the support part being connected to the fixing sleeve by at least two connecting ribs.

4 Claims, 2 Drawing Figures

FIG. 1
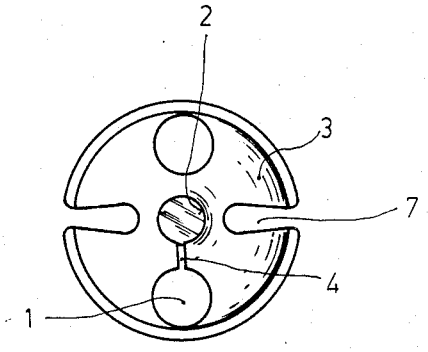
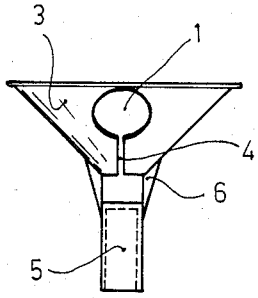
FIG. 2

BALLOON SUPPORT

The present invention refers to a "Ballon Support" with a concave support part provided with at least one lateral opening, and with a fixing sleeve united to said part.

Brazilian Utility Model application No. MU 6101113 of the same inventor has already proposed a support for a decorative balloon which provides a secure and easily applicable fixing means. The support described in that document provides for the fixing of the inflated balloon by means of lateral openings or slots in which the mouth-piece of the balloon should be introduced, the mouth-piece being stretched and passed through the slots.

Such configuration, however, has the disadvantage that the mouth-piece of the balloon is pulled towards one side, whereby the balloon stays crooked on the support.

The purpose of the present invention is thus to propose a balloon support which permits a centralized adjustment of the balloon on the support without making the fixing operation difficult.

This object is obtained by the fact that one of the lateral openings is connected to a bottom opening in the support part, by means of a cut or slit, the support part being connected to the fixing sleeve by at least two connecting ribs.

The manner of use and greater details of a preferred embodiment of the invention become clear from the following more detailed description thereof with reference to the drawings, in which:

FIG. 1 is a top view of the balloon support; and

FIG. 2 is a side view of the support of FIG. 1.

The support shown in the drawings basically comprises an inverted conical concave support part 3, which is connected by means of two connecting ribs 6 to a fixing sleeve 5, in a form of a tubular socket.

The side wall of support part 3 is provided with two diametrically opposite lateral openings 1 and two slots 7 shifted throughout about 90° C. relative thereto, which extend from the outer periphery of part 3 towards the center thereof.

Centrally of the bottom of support part 3, a bottom opening 2 is provided, which is connected to one of the lateral openings 1 by means of a cut or slit 4.

Consequently, an inflated ballon may be fixed to the support by stretching its mouth-piece, passing it through that side opening 1 which is connected to slit 4, and between ribs 6, and pulling it so that it is forced to pass through slit 4 to the bottom opening 2, whereby the balloon takes up a centralized position on the support. Fixing is then ensured by passing the mouth-piece through one of the slots 7, and inwardly of the plate, passing it once more outwardly through the other slot 7.

The fixing sleeve 5 may receive one end of an elongated stick so as to facilitate handling of assembly by a child.

It should be understood that one specific example of the invention having been described, it may undergo various modifications within the same basic idea, whereby the invention should be limited solely by the scope of the following claims.

I claim:

1. A balloon support comprising:

a concave support part, a first lateral opening through said concave support part, a central opening centrally provided through the bottom of said concave support part, a cut or slit through said concave support part connecting said first lateral opening to said central opening, two slots through said concave support part extending from the outer periphery thereof at least essentially towards the center thereof, said slots being radially oriented about 90° with respect to said first lateral opening, a fixing sleeve suitable for receiving one end of an elongated stick, and two connecting ribs connecting said fixing sleeve to said concave support part in spaced apart relationship, so that said fixing sleeve is centrally disposed below the bottom of said concave support part.

2. The balloon support according to claim 1 wherein the said support part is conical.

3. The balloon support according to claim 1, further comprising a second lateral opening through said concave support part, provided diametrically opposite said first lateral opening.

4. The balloon support according to claim 1, wherein said fixing sleeve has a tubular socket shape.

* * * * *